US006318716B1

(12) United States Patent
Okuda

(10) Patent No.: US 6,318,716 B1
(45) Date of Patent: Nov. 20, 2001

(54) SHEET SEPARATING APPARATUS

(75) Inventor: Kazuhisa Okuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/465,316

(22) Filed: Dec. 17, 1999

(30) Foreign Application Priority Data

Dec. 24, 1998 (JP) ..... 10-367221

(51) Int. Cl.[7] ..... B65H 3/52
(52) U.S. Cl. ..... 271/121; 271/124
(58) Field of Search ..... 271/121, 124, 271/167, 104

(56) References Cited

FOREIGN PATENT DOCUMENTS

466171 A2 * 1/1992 (EP) ..... 271/121
0321230 * 12/1989 (JP) ..... 271/121
403061235A * 3/1991 (JP) ..... 271/121
403088645 * 4/1991 (JP) ..... 271/121
403102032A * 4/1991 (JP) ..... 271/121
405043077A * 2/1993 (JP) ..... 271/121

* cited by examiner

*Primary Examiner*—H. Grant Skaggs
(74) *Attorney, Agent, or Firm*—Fitzpatrick, Cella, Harper & Scinto

(57) ABSTRACT

A separating apparatus has a sheet feeding unit for feeding sheets, a separating pad for separating the sheets between the separating pad and the sheet feeding unit, a pad holding member for holding the separating pad, a spring for biasing the pad holding member to thereby bring the separating pad into pressure contact with the sheet feeding unit, a support for supporting the pad holding member on a frame pivotably and movably in a sheet feeding direction, and an abutting surface against which the pad holding member abuts when the pad holding member moves to a downstream side in the sheet feeding direction.

10 Claims, 5 Drawing Sheets

SHEET SEPARATING APPARATUS

BACKGROUND OF THE INVENTION

1. Field of the Invention

This invention relates to a sheet separating apparatus provided in an image forming apparatus such as a copying machine, a printer or a facsimile apparatus for separating and feeding out recording sheets and originals one by one.

2. Related Background Art

An image forming apparatus has heretofore been equipped with a sheet separating apparatus for separating and supplying recording sheets and originals one by one to an image forming portion and an original reading portion. In this sheet separating apparatus, use is made of various separating systems such as a separating pawl (claw), a separating pad and a reversely rotating roller in conformity with the separating property, cost, etc.

FIG. 5 of the accompanying drawings shows an example of a sheet separating apparatus adopting a separating system using a separating pad according to the prior art. This will hereinafter be schematically described.

The reference numeral 50 designates a sheet feeding roller which is rotated in the direction of arrow E to thereby feed out recording sheets or originals (hereinafter referred to as sheets) P stacked (piled) on a sheet feeding tray 51 and a pressure plate 52. The pressure plate 52 is supported for pivotal movement in the directions of arrow A-B about a shaft 53, and biases the leading end side of the piled sheets P toward the sheet feeding roller 50 by a spring member, not shown and brings the sheets into pressure contact with the sheet feeding roller 50. The pressure plate 52 is provided with a friction pad 52*a* for preventing the sheets from being fed out as a bundle when the number of the piled sheets has become small.

A separating pad 54 for separating the sheets is provided on the downstream side of the pressure plate 52 with respect to the sheet feeding direction. This separating pad 54 is held on a pad holder 56 supported pivotally in the directions of arrow C-D about a shaft 55, and is brought into pressure contact with the sheet feeding roller 50 by a separating spring 57.

According to this construction, the sheets brought into pressure contact by the pressure plate 52 are fed out toward the separating pad 54 by the sheet feeding roller 50 being rotated in the direction of arrow E. These sheets thus fed out are separated one by one between the sheet feeding roller 50 and the separating pad 54 and fed toward the downstream side. To reliably separate the sheets in this case, the coefficient of friction between the surface of the separating pad 54 and the surface of the sheet feeding roller 50 must be higher than the coefficient of friction between the sheets, and need generally that $\mu$ is equal to 1 or greater with the kind of the sheets used and environmental conditions such as temperature and humidity taken into account.

The sheet separating apparatus adopting the above-described separating pad system according to the prior art, however, has suffered from the following problem.

As described above, the coefficient of friction between the sheet feeding roller 50 and the separating pad 54 is sufficiently high for the separation of the sheets. Therefore, if the sheet feeding roller 50 is rotated with no sheet inserted in the nip portion (the portion of pressure contact) between the sheet feeding roller 50 and the separating pad 54, i.e., with the sheet feeding roller 50 and the separating pad 54 directly brought into pressure contact with each other as shown in FIG. 5, a minute slip stick phenomenon may occur between the sheet feeding roller 50 and the separating pad 54 and the separating pad may be vibrated to thereby cause unpleasant noise (chattering sound).

SUMMARY OF THE INVENTION

The present invention has been made in view of the above-noted problem and has as its object to provide a sheet separating apparatus which can prevent vibration causing the unpleasant noise of a separating pad by a simple construction without adversely affecting the separating performance.

The sheet separating apparatus of the present invention is characterized by:

- sheet feeding means for feeding sheets;
- a separating pad for separating the sheets between it and said sheet feeding means;
- a pad holding member for holding said separating pad;
- biasing means for biasing said pad holding member to thereby bring said separating pad into pressure contact with said sheet feeding means;
- supporting means for supporting said pad holding member on a frame pivotably and movably in a sheet feeding direction; and
- an abutting surface against which said pad holding member abuts when said pad holding member moves to a downstream side with respect to the sheet feeding direction.

DESCRIPTION OF THE PREFERRED EMBODIMENTS

Some embodiments of the present invention will hereinafter be described with reference to FIGS. 1 to 4. A copying machine (image forming apparatus) equipped with the sheet separating apparatus of the present invention will first be schematically described with reference to FIG. 4.

Figure 4:
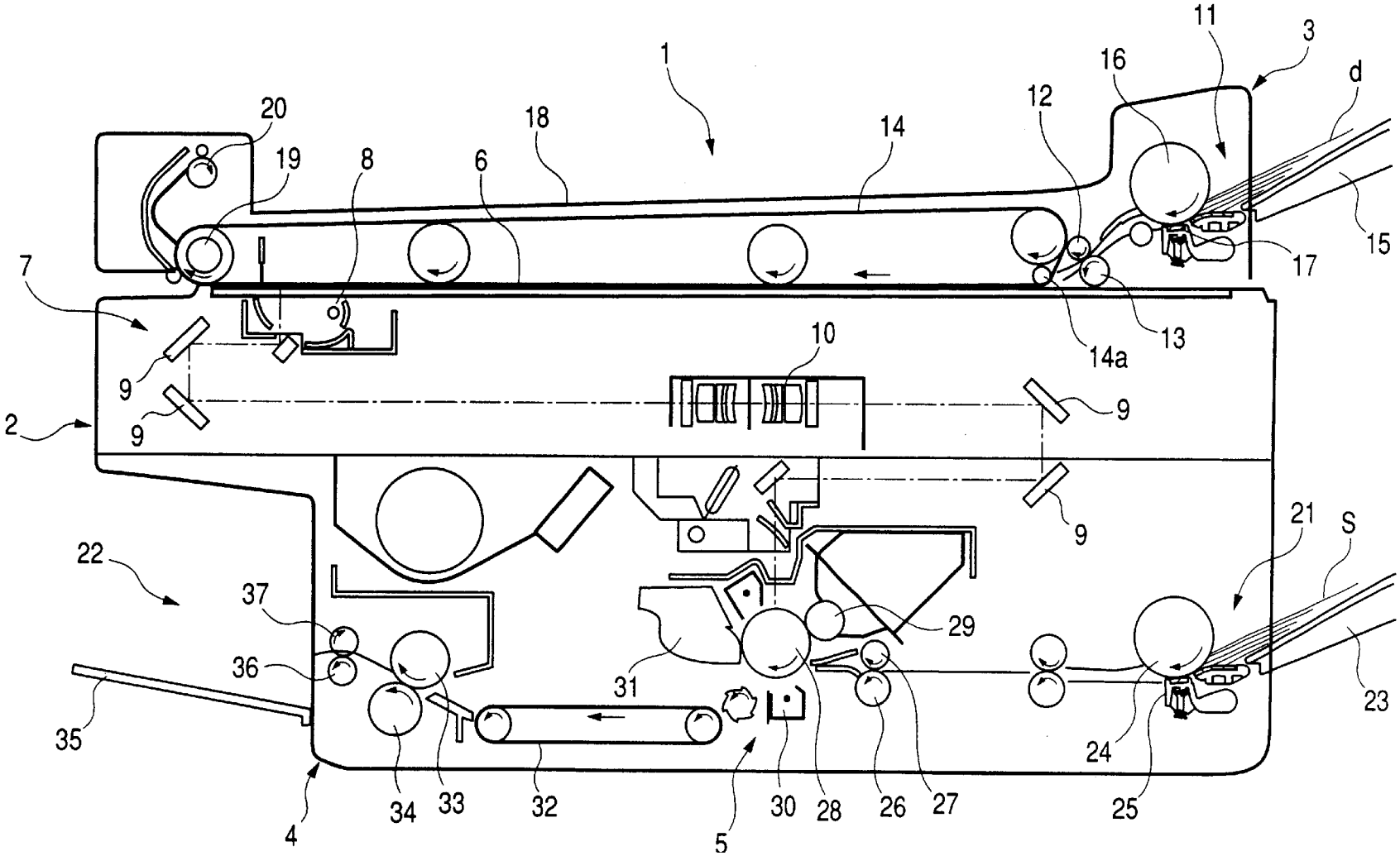
FIG. 4 is a cross-sectional view showing an example of a copying machine equipped with the sheet separating apparatus of the present invention.
Figure 5:
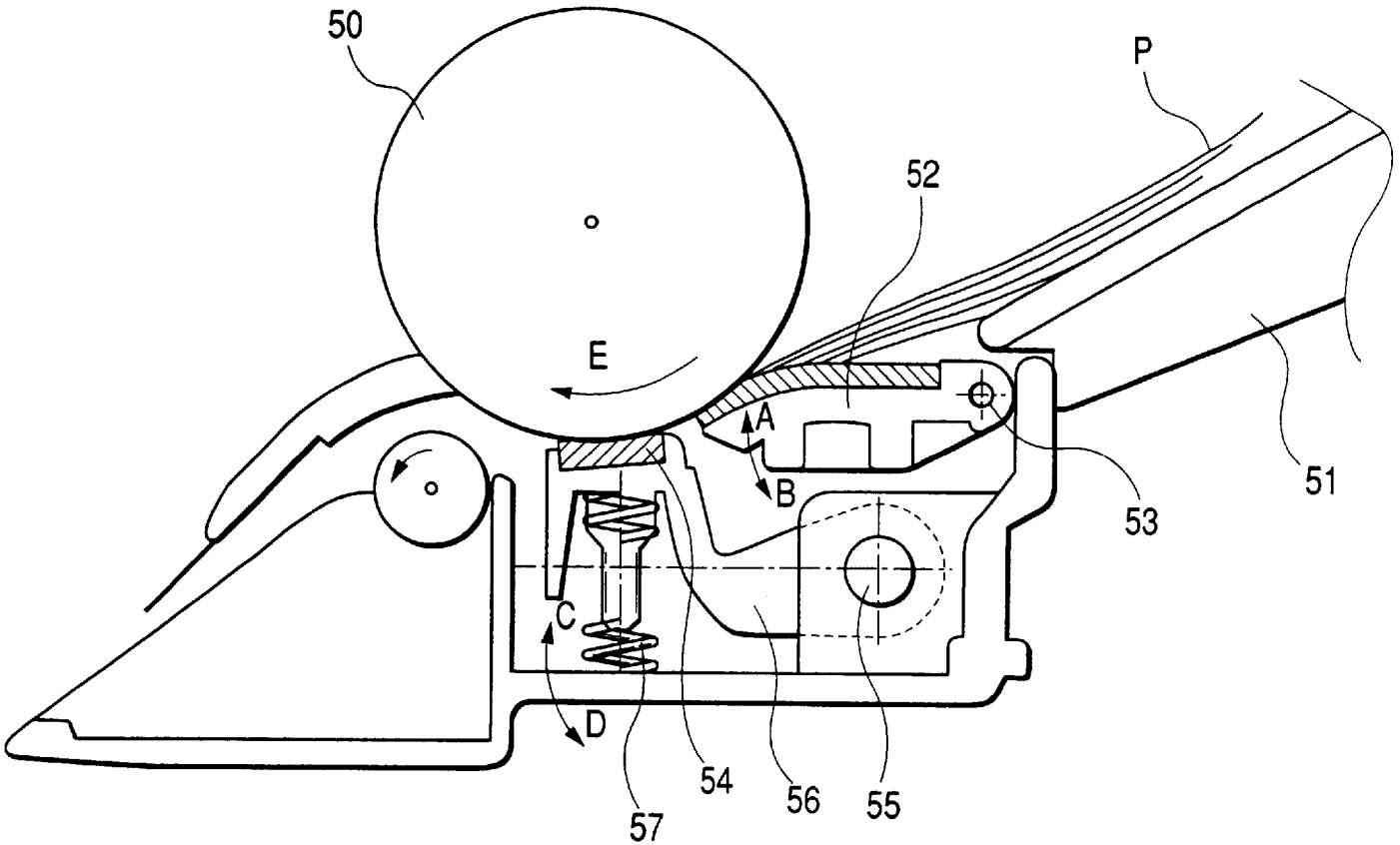
FIG. 5 PRIOR ART
FIG. 5 is a cross-sectional view showing an example of a sheet separating apparatus according to the prior art.

In FIG. 4, this copying machine 1 has an image reading apparatus 2 for reading the image information of an original, an auto original feeder (ADF: auto document feeder) 3 for automatically supplying the original to the image reading apparatus 2, and a copying machine main body 4 having an image forming portion 5 for recording an image read by the image reading apparatus 2 on a recording sheet. The image reading apparatus 2, the auto original feeder 3 and the copying machine main body 4 will hereinafter be described.

[Image Reading Apparatus]

The image reading apparatus 2 is provided with an optical reading device 7 for reading the image of the original placed on a platen 6. This optical reading device 7 has a lamp 8 for applying light to the original on the platen 6, a reflecting mirror 9 for sending the light reflected by the original to an image forming portion 5 which will be described later, a lens 10, etc.

[Auto Original Feeder]

The auto original feeder 3 automatically supplies an original of which the image is to be read by the image reading apparatus 2 onto the platen 6, and has an original separating apparatus 11 to which the present invention is applied, a pair of registration rollers 12 and 13 and a conveying belt 14 for moving the original d separated by the original separating apparatus 11 onto the platen 6.

The original separating apparatus 11 has a sheet supply tray 15 for supporting the originals d thereon, a sheet feeding roller 16 for feeding out the originals, and a separating pad 17 for separating the fed-out originals d one by one, and the construction of this original separating apparatus will be described later in detail.

The original d fed out from the original separating apparatus 11 is sent to the entrance side 14*a* of the conveying belt 14 with the skew feeding thereof corrected by the pair of registration rollers 12 and 13 and in timed relationship with the copying machine main body side. The conveying belt 14 is for conveying the original d to a predetermined position on the platen 6, and is disposed along the platen 6. Discharge rollers 19 and 20 for discharging the original onto an original discharge tray 18 are provided on the exit side of the conveying belt 14.

[Image Forming Portion]

The copying machine main body 4 has therein a recording sheet separating apparatus 21 capable of separating recording sheets S one by one and continuously feeding out them, an image forming portion 5 for forming the images read by the image reading apparatus on the fed-out recording sheets S, and a discharge portion 22 for discharging the recording sheets on which the images have been formed by the image forming portion 5.

The recording sheet separating apparatus 21 is of a construction similar to that of the original separating apparatus 11, and serves to feed out the recording sheets S piled on a sheet supply tray 23 by a sheet feeding roller 24, and separate them one by one by a separating pad 25, and this will also be described later in detail.

Provision is made of a pair of registration rollers 26 and 27 for correcting the skew feeding of the recording sheets S fed out from the recording sheet separating apparatus 21 and adjusting the timing of image formation, and images are formed on the recording sheets conveyed by the pair of registration rollers 26 and 27 in the image forming portion 5.

The image forming portion 5 is of an electrophotographic type popular construction and comprises a photosensitive drum 28 and a developing portion 29, a transfer charger 30, a cleaning portion 31, etc. disposed around the photosensitive drum 28 and therefore, need not be described in detail. Also, conveying means 32 and a pair of heating and fixing rollers 33 and 34 are disposed on the downstream side of the photosensitive drum 28.

In the discharge portion 22, there are provided a pair of discharge rollers 36 and 37 for discharging the recording sheets having images formed thereon onto a sheet discharge tray 35.

The operations of the image reading apparatus 2, the auto original feeder 3 and the copying machine main body 4 will now be described briefly. The originals d to be copied are set on the original separating apparatus 11. Also, the recording sheets S on which the image of the originals d are to be formed are set on the recording sheet separating apparatus 21. The originals d separated one by one by the original separating apparatus 11 are fed out toward the platen 6 in synchronism with the operation of the copying machine main body 4 by the pair of registration rollers 12 and 13. When the original is conveyed to a predetermined position on the platen 6 by the conveying belt 14, the image reading apparatus 2 scans the original d and sends the image information thereof to the image forming portion 5.

On the other hand, in the recording sheet separating apparatus 21, the recording sheets S are separated one by one and fed out to the pair of registration rollers 26 and 27. The pair of registration rollers 26 and 27 feed out the recording sheet S in synchronism with the image developed on the photosensitive drum 28.

The image on the photosensitive drum 28 is transferred to the recording sheet S between the photosensitive drum 28 and the transfer charger 30, and the recording sheet S is sent toward the pair of heating and fixing rollers 33 and 34. The pair of heating and fixing rollers 33 and 34 fix the toner image on the recording sheet S. The recording sheet S on which the image has been fixed is discharged onto the sheet discharge tray 35 by the pair of sheet discharge rollers 36 and 37. Also, the original d having had its image read is discharged onto the original discharge tray 18 by the discharge rollers 19 and 20.

Figure 1:
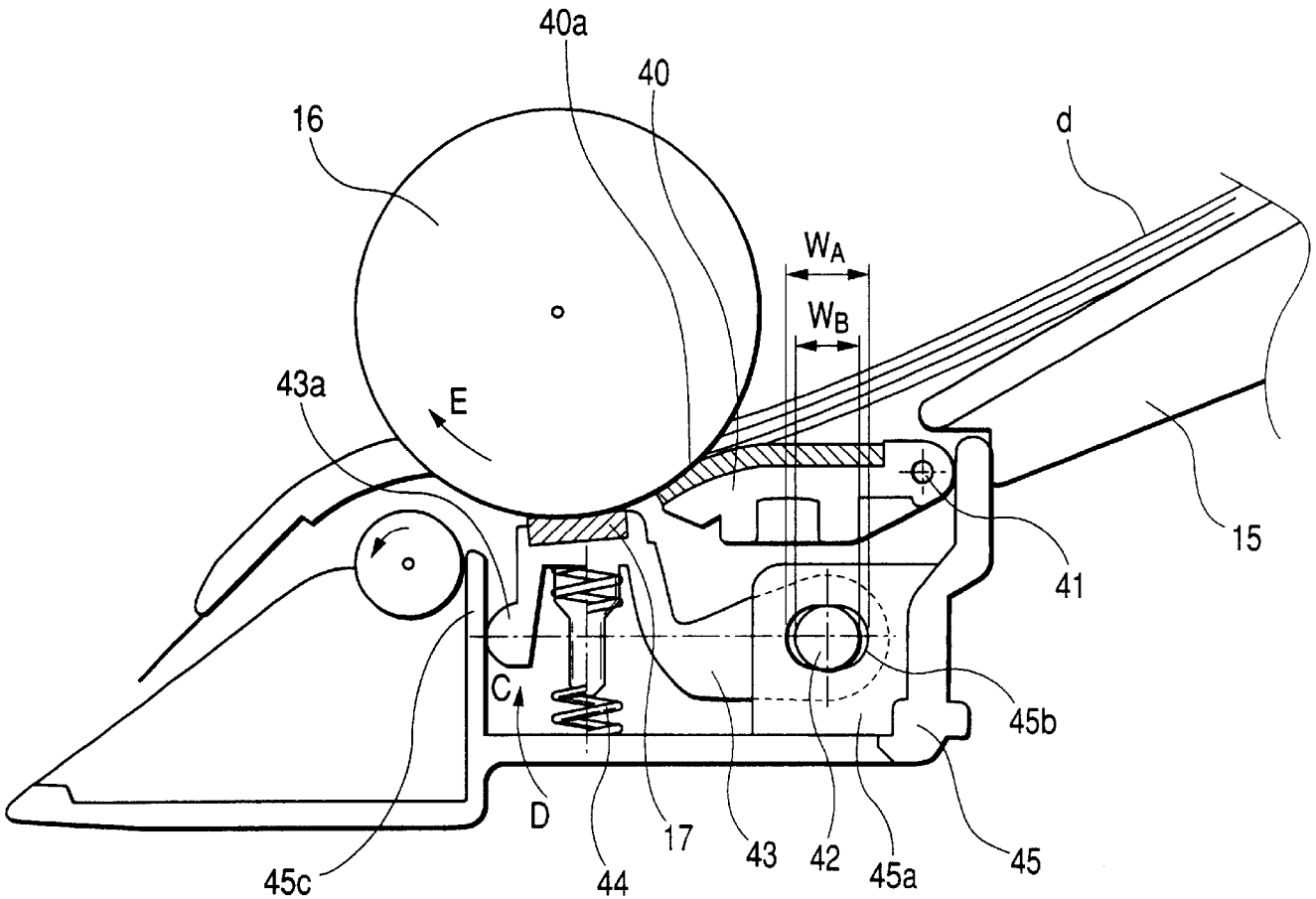
FIG. 1 is a cross-sectional view of the essential portions of a sheet separating apparatus according to a first embodiment of the present invention.
Figure 2:
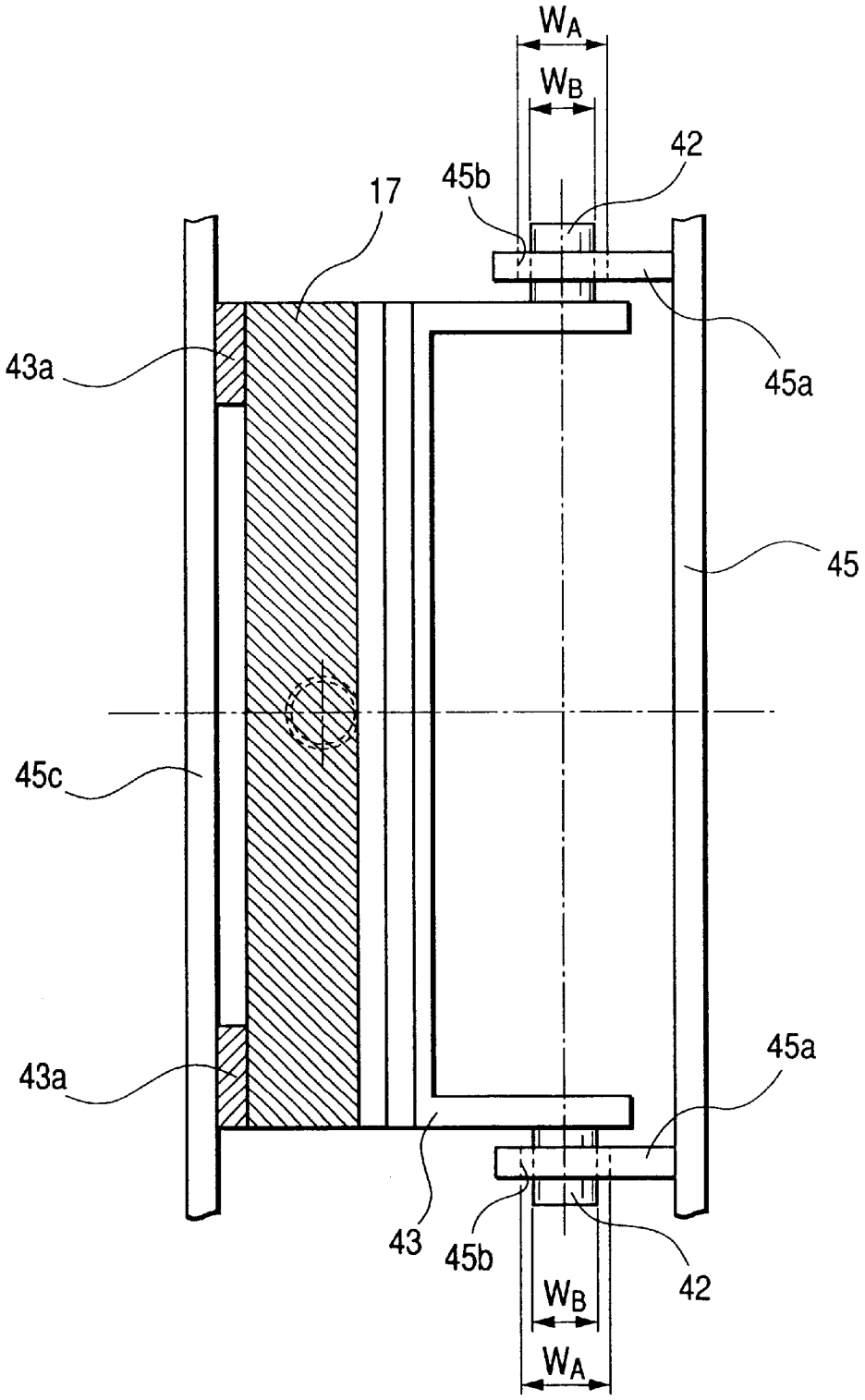
FIG. 2 is a plan view showing the supporting structure of the separating pad of the sheet separating apparatus shown in FIG. 1.

The original separating apparatus 11 and the recording sheet separating apparatus 21 to which the present invention is applied will be described here with reference to FIGS. 1 to 3, but these two apparatuses are substantially of the same construction and therefore, the original separating apparatus 11 will be described in detail and the description of the recording sheet separating apparatus 21 will be omitted.

The sheet feeding roller 16 as sheet feeding means, as described in connection with the prior art, is rotated in the direction of arrow E in FIG. 1 to thereby feed out the originals d piled on the sheet supply tray 15 and a pressure plate 40. The pressure plate 40 is supported pivotably about a shaft 41, and biases the leading end side of the piled originals d toward the sheet feeding roller 16 by a spring member, not shown, and brings the originals d into pressure contact with the sheet feeding roller 16. The pressure plate 40 is provided with a friction pad 40*a* for preventing the originals from being fed out as a bundle when the number of the piled originals has become small.

The separating pad 17 for separating the originals d is provided on the downstream side of the pressure plate 40 with respect to the sheet feeding direction. This separating pad 17 is held on a pad holder 43 as pad holding means supported for pivotal movement in the directions of arrow C-D in FIG. 1 about a shaft 42 provided integrally with the separating pad 17, and is urged toward the sheet feeding roller 16 by a separating spring 44 as biasing means. The originals d piled on the pressure plate 40 and the sheet supply tray 15 are fed out by the sheet feeding roller 16 being rotated, and are separated one by one by the separating pad 17.

The mounting structure (supporting means) for the separating pad which is an essential portion of the present invention will now be described.

The shaft 42 for making the pad holder 43 supporting the separating pad 17 pivotable is supported in a support hold 45*b* formed in a rib 45*a* provided on a frame 45. When the outer diameter of this shaft 42 is defined as ϕWB and the longitudinal length of the support hole 42*a* formed into a long hole which is long in the sheet feeding direction (the left-to-right direction in FIG. 1) is defined as WA, WA and WB are set so that WA>WB. Here, the value of WA−WB is generally set to the order of 0.3 to 0.5 mm. Thereby, the pad holder 43 is movable over a minute dimension in the sheet feeding direction.

A projection 43*a* is integrally formed on that end portion of the pad holder 43 which is opposite to the shaft 42, and this projection 43*a* is formed so as to abut against the abutting surface of an abutting wall 45*c* formed on a frame 45. Even if the actual dimensions of the projection 43*a* and the abutting wall 45*c* become irregular from the set values thereof, whereby the relative position of the projection 43*a* and the abutting surface of the abutting wall 45*c* deviates more or less, the pivotal movement of the pad holder 43 is not hindered because as previously described, the pad holder 43 is supported for movement over a minute dimension, and thus, the resilient force of the separating spring 44 is efficiently imparted to the separating pad 17.

The action of the above-described construction will now be explained.

Even if minute slip stick occurs between the sheet feeding roller 16 and the separating pad 17 when the sheet feeding roller 16 is rotated with the original d not inserted between the sheet feeding roller 16 and the separating pad 17, the pad holder 43 is moved by a frictional force acting between the sheet feeding roller 16 and the separating pad 17 and the projection 43*a* is pressed against the abutting wall 45 and thus, the vibration of the separating pad 17 and the pad holder 43 is suppressed. Thereby, the creation of unpleasant sound can be prevented.

Further, the greater becomes the frictional resistance between the sheet feeding roller 16 and the separating pad 17, the greater becomes the pressure force between the projection 43*a* and the abutting wall 45*c* and the vibration of the separating pad 17 and the pad holder 43 is suppressed more strongly and the noise can be prevented reliably.

Thus, in the present embodiment, the vibration of the separating pad 17 and the pad holder 43 can be effectively suppressed and prevent to thereby prevent unpleasant noise from being created. In this case, the pad holder 43 is held so as to be movable back and forth in the sheet feeding direction and therefore, the pivotal movement of the pad holder 43 is not hindered and the pressure force of the separating spring 44 works so as to reliably urge the separating pad 17 against the sheet feeding roller 16 and thus, stable sheet feeding and separating performance can be maintained. Thereby, there can be provided a nice sheet separating apparatus.

Also, the projection 43*a* is formed integrally with the pad holder 43 and the abutting wall 45*c* is formed integrally with the frame 45 and therefore, as compared with the prior-art apparatus, it is not necessary to add parts or the like and thus, an increase in cost does not occur.

A second embodiment of the present invention will now be described with reference to FIG. 3. This embodiment only differs from the first embodiment in the construction wherein the pad holder 43 abuts against the abutting wall 45*c* of the frame 45, and only the different construction will be described in detail and the same portions as those in the first embodiment are given the same reference characters and need not be described in detail.

Figure 3:
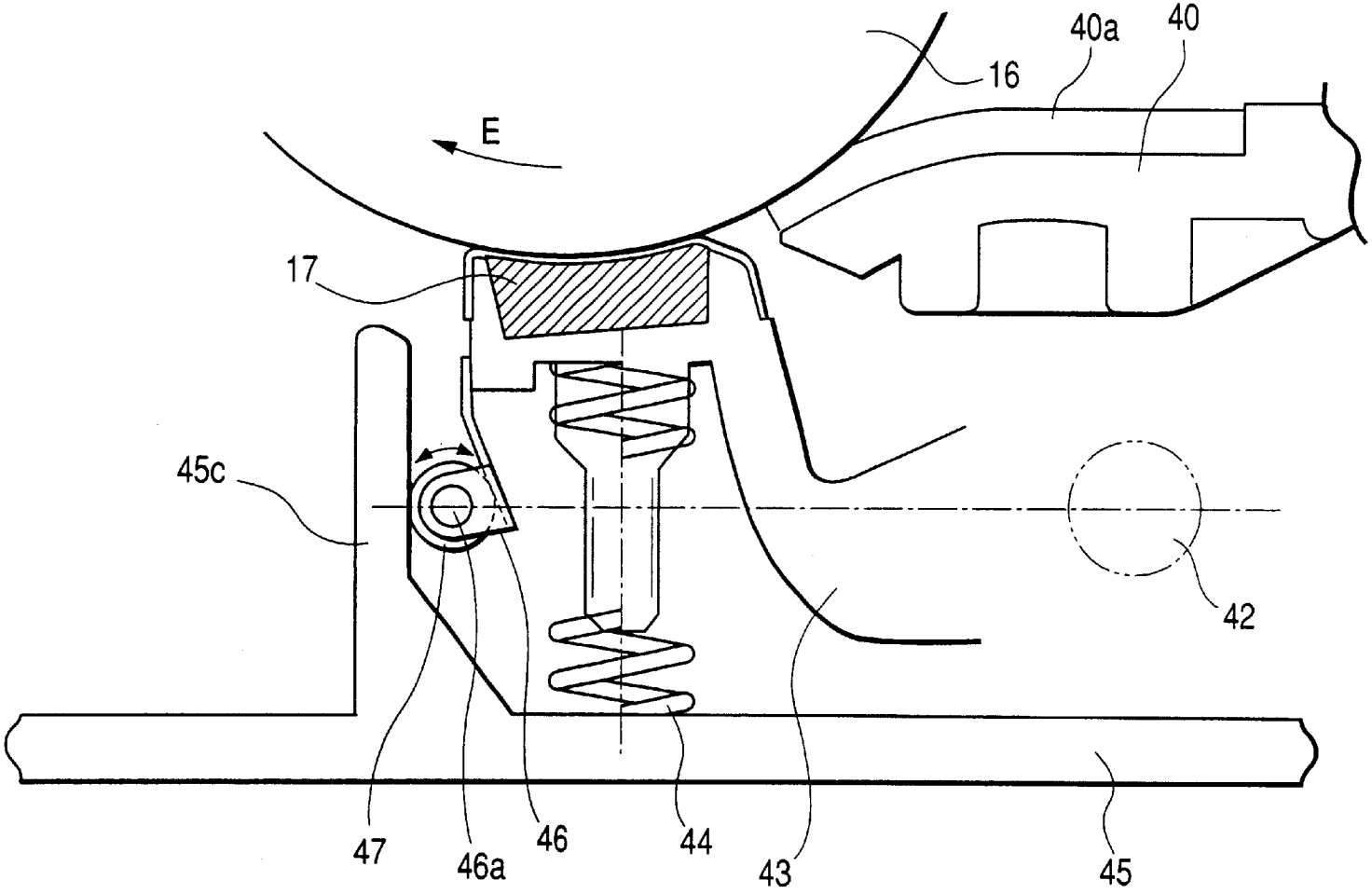
FIG. 3 is a cross-sectional view of the essential portions of a sheet separating apparatus according to a second embodiment of the present invention.

In FIG. 3, in that end portion of the pad holder 43 which is opposite to the shaft 42, a roller member 47 is rotatably supported on a roller shaft 46*a* mounted to a roller supporting member 46. This roller member 47 has its relative position set so as to become capable of abutting against the abutting wall 45*c* of the frame 45.

According to this construction, the roller member 47 is used instead of the projection 43*a* of the pad holder 43 in the first embodiment and therefore, the resistance during the pivotal movement of the pad holder 43 becomes rolling resistance and the pivotal movement resistance of the pad holder 43 is more reduced. Thereby, the loss of the biasing force of the separating spring 44 is greatly decreased and stable sheet feeding and separating performance is obtained. Again in this embodiment, as in the first embodiment, the vibration of the separating pad 17 and the pad holder 43 is suppressed and the creation of noise is suppressed and a nice sheet separating apparatus can be provided.

The present invention is not restricted to the above-described embodiments, but for example, a material such as Teflon which is small in sliding resistance may be stuck on the projection 43*a* provided on the pad holder 43 in the first embodiment and the abutting wall 45*c* provided on the frame 45 so as to reduce the loss of the biasing force of the separating spring 44. Also, as means for pivotally and movably supporting the separating pad 17, the shaft 42 is provided on the pad holder 43 and the supporting hole 45*b* is formed in the frame 45, but a construction converse to this may also be adopted.

What is claimed is:

1. A sheet separating apparatus comprising:

sheet feeding means for feeding sheets;

a separating pad for separating the sheets between said separating pad and said sheet feeding means;

a pad holding member for holding said separating pad;

biasing means for biasing said pad holding member to thereby bring said separating pad into pressure contact with said sheet feeding means;

supporting means for supporting said pad holding member on a frame pivotably and movably in a sheet feeding direction; and an abutting surface against which said pad holding member abuts when said pad holding member moves to a downstream side in the sheet feeding direction.

2. A sheet separating apparatus according to claim 1, wherein said supporting means supports said pad holding member pivotably and movably in the sheet feeding direction by forming a supporting hole in one of said frame and said pad holding member and providing in the other a shaft to be inserted into said supporting hole, and setting a dimension of said supporting hole in the sheet feeding direction to a dimension larger than a dimension of said shaft, and during an operation of said sheet feeding means, said pad holding member moves and abuts against said abutting surface as said separating pad is moved in the sheet feeding direction by a frictional force thereof with said sheet feeding means.

3. A sheet separating apparatus according to claim 2, wherein said supporting hole is a long hole longer in the sheet feeding direction than the dimension of said shaft.

4. A sheet separating apparatus according to claim 3, wherein the dimension of said long hole in a longitudinal direction thereof is larger by 0.3 to 0.5 mm than the dimension of said shaft.

5. A sheet separating apparatus according to claim 2, wherein a projection is integrally formed on a region of said pad holding member which abuts against said abutting surface.

6. A sheet separating apparatus according to claim 2, wherein a rotatable roller member is provided on a region of said pad holding member which abuts against said abutting surface.

7. A sheet separating apparatus according to claim 1, wherein said pad holding member is supported on said frame by said supporting means, and said abutting surface is formed integrally with said frame on the downstream side of said pad holding member in the sheet feeding direction.

8. A sheet separating apparatus according to claim 1, wherein said sheet feeding means is a sheet feeding roller, and when said sheet feed roller is rotated, said sheet feeding roller feeds out the sheets biased against said sheet feeding roller by a pressure plate and cooperates with said separating pad to separate the fed-out sheets one by one.

9. An original reading apparatus comprising:

sheet feeding means for feeding originals;

a separating pad for separating the originals between said separating pad and said sheet feeding means;

a pad holding member for holding said separating pad;

biasing means for biasing said pad holding member to thereby bring said separating pad into pressure contact with said sheet feeding means;

supporting means for supporting said pad holding member on a frame pivotably and movably in a sheet feeding direction;

an abutting surface against which said pad holding member abuts when said pad holding member moves to a downstream side in the sheet feeding direction; and an image reading portion for reading images of the originals separated and fed out by said separating pad.

10. An image forming apparatus comprising:

sheet feeding means for feeding sheets;

a separating pad for separating the sheets between said separating pad and said sheet feeding means;

a pad holding member for holding said separating pad;

biasing means for biasing said pad holding member to thereby bring said separating pad into pressure contact with said sheet feeding means;

supporting means for supporting said pad holding member on a frame pivotably and movably in a sheet feeding direction;

an abutting surface against which said pad holding member abuts when said pad holding member moves to a downstream side in the sheet feeding direction; and an image forming portion for forming images on the sheets separated and fed out by said separating pad.

* * * * *

UNITED STATES PATENT AND TRADEMARK OFFICE

CERTIFICATE OF CORRECTION

PATENT NO. : 6,318,716 B1
DATED : November 20, 2001
INVENTOR(S) : Kazuhisa Okuda It is certified that error appears in the above-identified patent and that said Letters Patent is hereby corrected as shown below:

Column 5,
Line 39, "prevent to" should read -- prevented to --.

Signed and Sealed this

Ninth Day of April, 2002

*Attest:*

*Attesting Officer*

JAMES E. ROGAN
*Director of the United States Patent and Trademark Office*